US005784881A

United States Patent [19]

Otsuka et al.

[11] Patent Number: 5,784,881

[45] Date of Patent: Jul. 28, 1998

[54] MULTI-PART EXHAUST MANIFOLD ASSEMBLY WITH WELDED CONNECTIONS

[75] Inventors: Koki Otsuka; Kenji Itoh, both of Moka, Japan

[73] Assignee: Hitachi Metals, Ltd., Tokyo, Japan

[21] Appl. No.: 782,491

[22] Filed: Jan. 10, 1997

[30] Foreign Application Priority Data

Jan. 11, 1996 [JP] Japan ..... 8-002883
Mar. 5, 1996 [JP] Japan ..... 8-047092

[51] Int. Cl.[6] ..... F01N 7/00

[52] U.S. Cl. ..... 60/322; 285/299

[58] Field of Search ..... 60/322; 285/226, 285/299

[56] References Cited

U.S. PATENT DOCUMENTS 5,145,215 9/1992 Udell ..... 60/322
5,340,165 8/1994 Sheppard ..... 60/322

FOREIGN PATENT DOCUMENTS 54-97623 12/1977 Japan .
54-163221 5/1978 Japan .
55-163425 11/1980 Japan .
55-182305 6/1984 Japan .
5-86855 4/1993 Japan .
5-202745 8/1993 Japan .

*Primary Examiner*—Thomas E. Denion
*Attorney, Agent, or Firm*—Finnegan, Henderson, Farabow, Garrett & Dunner

[57] ABSTRACT

An exhaust manifold assembly including at least two manifold part members, an annular end projection of one manifold part member receiving an annular end projection of the other manifold part member to form a connection portion, further including (a) an annular slidable tubular member made of a metal material having good heat resistance and oxidation resistance and inserted into a gap between the annular end projections of both manifold part members; and (b) a flexible pipe having a corrugated pipe portion and tubular portions integrally extending from both ends of the corrugated pipe portion, the tubular portions of the flexible pipe being continuously welded to outer surfaces of the manifold part members, whereby the connection portion is completely sealed by the flexible pipe.

9 Claims, 6 Drawing Sheets

MULTI-PART EXHAUST MANIFOLD ASSEMBLY WITH WELDED CONNECTIONS

BACKGROUND OF THE INVENTION

The present invention relates to an exhaust manifold assembly suitable for automobile engines having a structure in which a plurality of manifold part members are connected to each other, and particularly to an exhaust manifold assembly comprising manifold part members having telescopically connected annular end projections whose adhesion and fixing due to oxidation and corrosion are prevented to avoid the cracking of the manifold part members, the leakage of an exhaust gas from the exhaust manifold assembly, etc.

Some elongated exhaust manifolds for multi-cylinder engines are constituted by two or three manifold part members not only to prevent their thermal deformation and cracking due to the repeated start and stop of engines but also to prevent the leakage of an exhaust gas. In such divided exhaust manifolds, connection parts are telescopically extendable to adjust the exhaust manifolds to the thermal expansion and shrinkage due to heating and cooling.

For instance, Japanese Utility Model Laid-Open No. 55-163425 discloses, as shown in FIGS. 5(*a*) and 5(*b*), an exhaust manifold assembly or divided exhaust manifold in which manifold part members 51, 54 are connected to each other such that an annular end projection 52 of one manifold part member 51 receives an annular end projection 55 of the other manifold part member 54. In this exhaust manifold assembly, the annular end projection 55 of the inserted manifold part member 54 has several annular grooves 58 on its outer surface 56 to which seal rings 59 in the shape of piston rings are mounted, and the slide contact of the seal rings 59 with the inner surface 53 of the annular end projection 52 of the manifold part member 51 serves to prevent the leakage of an exhaust gas. Japanese Utility Model Laid-Open No. 55-163425 also discloses, as shown in FIG. 6, an exhaust manifold assembly having a structure in which one or both of the inner surface 53 of the annular end projection 52 and the outer surface 56 of the annular end projection 55 are provided with a plurality of annular grooves 60 to prevent the leakage of an exhaust gas without using seal rings 59.

In both cases shown in FIGS. 5(*a*) and 5(*b*) and 6, the exhaust manifold assemblies disclosed in Japanese Utility Model Laid-Open No. 55-163425 are excellent in resistance to thermal stress due to the usual start and stop of engines, sealing of an exhaust gas, etc. However, when they are used for engines equipped with turbo chargers or exhaust gas brakes, an exhaust gas is likely to enter into a gap between the inner surface 53 of the annular end projection 52 and the outer surface 56 of the annular end projection 55, because a higher-pressure exhaust gas flows into the exhaust manifold assemblies. In the case of manifold part members 51, 54 made of heat-resistant cast iron, they are oxidized and corroded by the exhaust gas for a long period of engine operation, resulting in the formation of oxidation-corrosion layer 62 as shown in a circle in FIGS. 5(*a*) and 5(*b*). The propagation of the oxidation-corrosion layer 62 leads to the adhesion and fixing of the inner surface 53 of the annular end projection 52 to the outer surface 56 of the annular end projection 55, making it impossible to displace these annular end projections 52, 55 telescopically depending on the thermal expansion and shrinkage due to the heating and cooling of engines. Accordingly, cracking easily takes place in the manifold part members 51, 54, resulting in a higher likelihood of leakage of an exhaust gas.

Japanese Patent Laid-Open No. 5-86855 discloses, as shown in FIG. 7, an exhaust manifold assembly having a structure in which an inner pipe 78 is disposed inside an inner surface 73 of an annular end projection 72 of one manifold part member 71 and an inner surface 77 of an annular end projection 76 of the other manifold part member 75 to constitute a connection portion, and a flexible pipe 80 consisting of a corrugated pipe portion 82 and inwardly bent tubular portions 81*a*, 81*b* integrally connected to both ends of the corrugated pipe portion 82 is mounted to the outer surfaces of both manifold part members 71, 75 to seal the connection portion. Support rings 84*a*, 84*b* are mounted around the outer surfaces of the tubular portions 81*a*, 81*b* of the flexible pipe 80, and the flexible pipe 80 and the support rings 84*a*, 84*b* are integrally welded to the outer surfaces of the manifold part members 71, 75. The resultant welds 86*a*, 86*b* seal the connection portion not only to prevent the exhaust gas from leaking from the exhaust manifold assembly but also to prevent the support rings 84*a*, 84*b* from inflicting damage to the flexible pipe 80 with their corners.

However, since the exhaust manifold assembly of Japanese Patent Laid-Open No. 5-86855 has a connection portion constituted only by the inner pipe 78 and the flexible pipe 80, the connection portion is poor in rigidity, suffering from poor handling in mounting the exhaust manifold assembly to an engine. Also, an oxidation-corrosion layer (not shown) is formed between the inner surfaces 73, 77 of the annular end projections 72, 76 of the manifold part members 71, 75 and the inner pipe 78 inserted thereinto. With the growth of the oxidation-corrosion layer, the inner surfaces 73, 77 of the annular end projections 72, 76 are adhered and fixed to the inner pipe 78, so that the exhaust manifold assembly cannot be telescopically extended or shortened depending on thermal expansion or shrinkage due to the heating and cooling of the engine. As a result, cracking easily takes place in the manifold part members 71, 75 and the inner pipe 78, leading to the leakage of an exhaust gas.

OBJECT AND SUMMARY OF THE INVENTION

Accordingly, an object of the present invention is to provide an exhaust manifold assembly whose manifold part members are not substantially adhered nor fixed to each other even though a connection portion constituted by a plurality of manifold part members is oxidized and corroded, ensuring the extension and shortening of the connection portion depending on thermal expansion and shrinkage due to the heating and cooling of engines, thereby preventing the cracking of the manifold part members and the leakage of an exhaust gas from the connection portion.

As a result of research in view of the above object, the inventors have found that by disposing a slidable tubular member between the annular end projections of both manifold part members and continuously welding a flexible pipe covering the connection portion of the manifold part members to the outer surfaces of the manifold part members, it is possible to prevent the oxidation and corrosion of the connection portion and the leakage of an exhaust gas from the connection portion. The present invention has been completed based on this finding.

Thus, the exhaust manifold assembly of the invention comprises at least two manifold part members, an annular end projection of one manifold part member receiving an annular end projection of the other manifold part member to form a connection portion, further comprising:

(a) a slidable tubular member inserted into a gap between the annular end projection of one manifold part member and the annular end projection of the other manifold part member; and (b) a flexible pipe comprising a corrugated pipe portion and tubular portions integrally extending from both ends of the corrugated pipe portion, the flexible pipe extending along the exhaust manifold assembly so as to cover the connection portion, the tubular portions of the flexible pipe being continuously welded to outer surfaces of the manifold part members, whereby the connection portion is completely sealed by the flexible pipe.

BRIEF DESCRIPTION OF THE DRAWINGS

FIG. 1(*b*) is a plan view showing the overall structure of the exhaust manifold assembly according to one embodiment of the present invention;

FIG. 2(*b*) is a partial end view showing the connection portion of the exhaust manifold assembly according to one embodiment of the present invention;

FIG. 3(*b*) is a partial end view showing the connection portion of the exhaust manifold assembly according to another embodiment of the present invention;

FIG. 4 (*b*) is a perspective view showing a slidable tubular member in the shape of a cylinder having a linear slit;

FIG. 4 (*c*) is a perspective view showing a slidable tubular member in the shape of a cylinder having a zigzag slit;

FIG. 5(*b*) is an enlarged view of the connection portions encircled in FIG. 5(*a*);

DETAILED DESCRIPTION OF THE PREFERRED EMBODIMENTS

The preferred embodiments of the present invention will be described in detail below referring to FIGS. 1–4 attached hereto.

[1] First Embodiment

Figure 1:
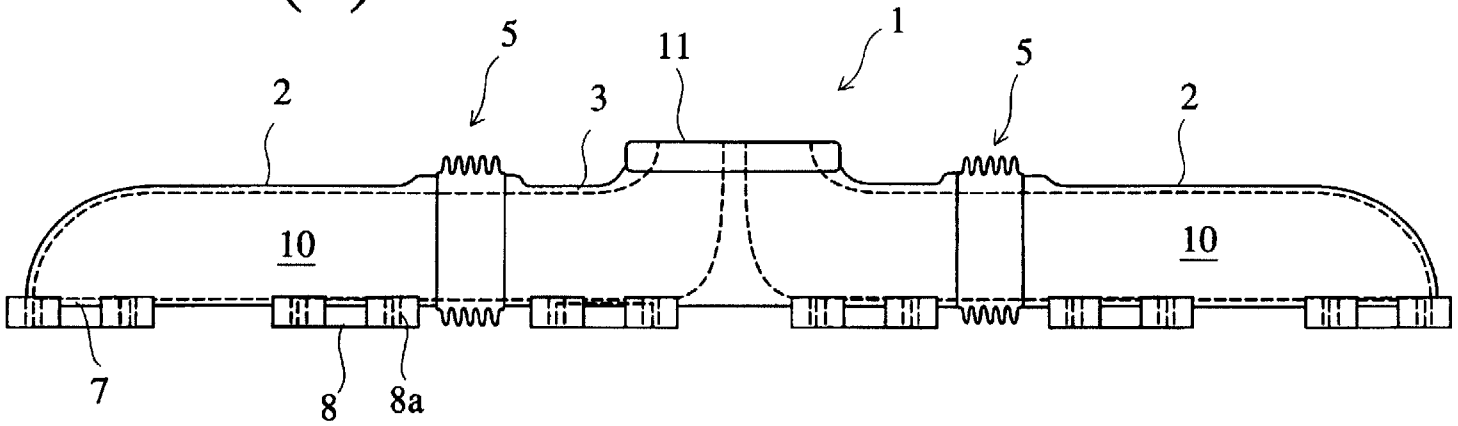
FIG. 1(*a*) is a side view showing the overall structure of the exhaust manifold assembly according to one embodiment of the present invention.
Figure 1:
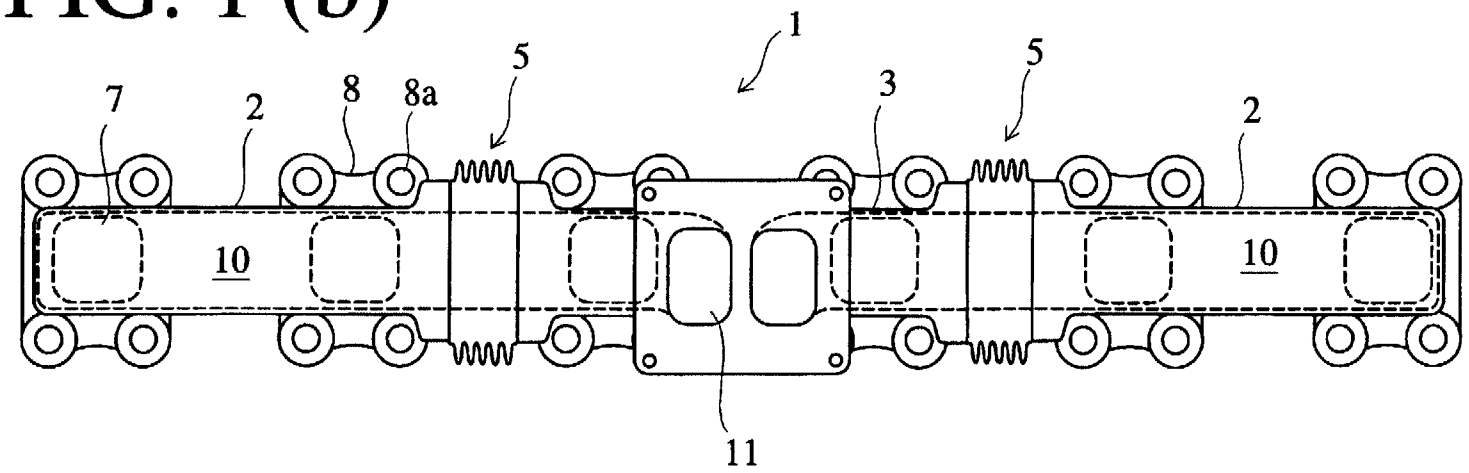

FIG. 1(*a*) is a side view showing the overall structure of the exhaust manifold assembly 1 according to the first embodiment of the present invention, and FIG. 1(*b*) is a plan view thereof. This exhaust manifold assembly 1 is suitably usable for in-line, six-cylinder diesel engines equipped with turbo chargers for large trucks. The exhaust manifold assembly 1 comprises a plurality of manifold part members 2, 3 and connection portions 5 positioned between the adjacent manifold part members. Each manifold part member 2, 3 has exhaust gas inlet openings 7 each communicating with a cylinder of the engine, a pair of separated paths 10 extending axially to the opposite direction from a center of the exhaust manifold assembly 1, each path 10 communicating with the exhaust gas inlet openings 7, and two outlet openings 11 located at a center of the exhaust manifold assembly 1, each of which is communicating with each path 10. Each inlet opening 7 is surrounded by a flange portion 8 having threading holes 8*a*.

Figure 2:
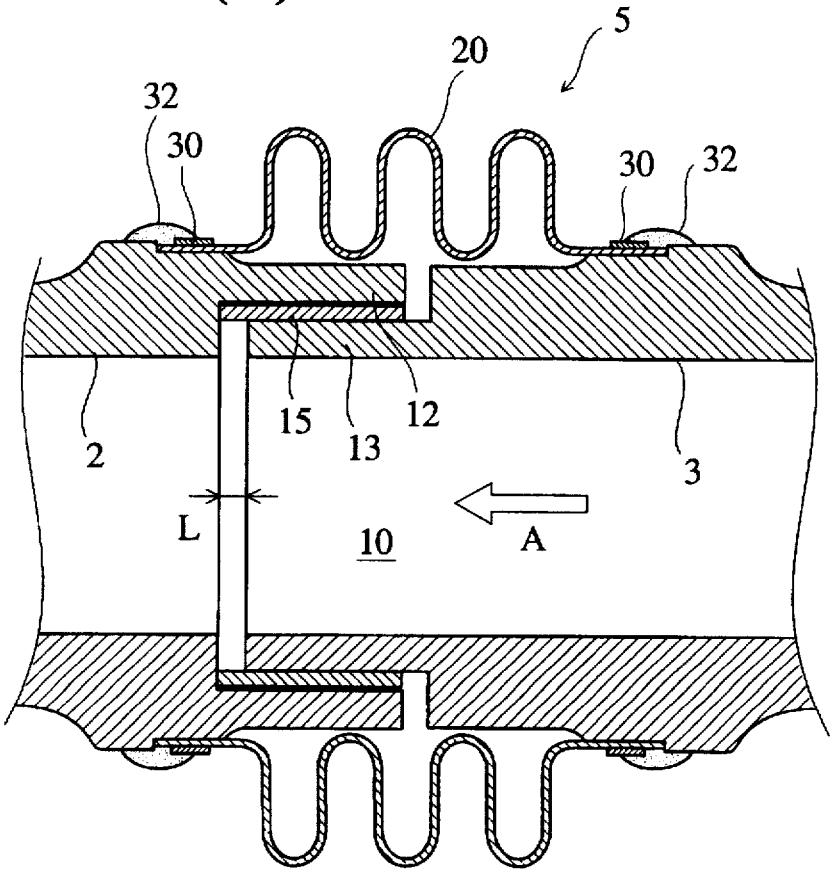
FIG. 2(*a*) is an enlarged cross-sectional view showing the connection portion of the exhaust manifold assembly according to one embodiment of the present invention.
Figure 2:
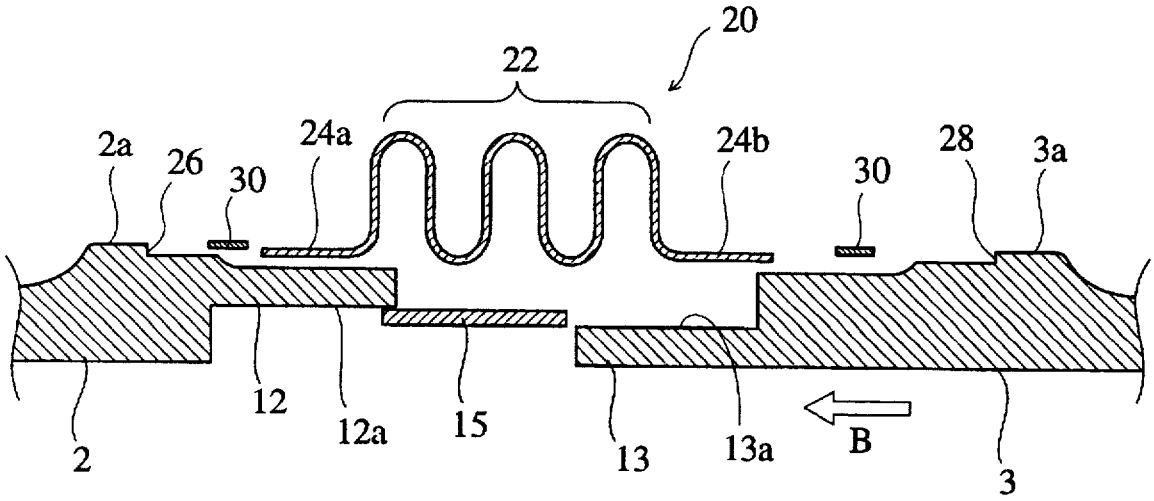

FIG. 2 shows the details of a connection portion 5 of the exhaust manifold assembly of FIG. 1. An exhaust gas discharged from an engine (not shown) flows in the exhaust manifold assembly 1 through the paths 10 of the manifold part members 2, 3 in the direction shown by the arrow A to the outlet opening 11 communicating with a turbo charger (not shown). The manifold part member 2 has an annular end projection 12 having a larger inner diameter than that of the path 10, and the manifold part member 3 has an annular end projection 13 having the same inner diameter as that of the path 10 and such an outer diameter that the annular end projection 13 is inserted into the annular end projection 12 with a proper gap. The annular end projections 12, 13 preferably have proper thickness to avoid heat cracking and deformation.

As shown in FIGS. 2(*a*) and (*b*), a slidable tubular member 15 is inserted into a gap between the annular end projections 12 and 13. The slidable tubular member 15 is preferably made of a material having good heat resistance and oxidation resistance, for instance, stainless steel. The slidable tubular member 15 may be loosely fitted into the gap between the annular end projections 12 and 13 or may be fixed to one of the annular end projections 12, 13. The slidable tubular member 15 is preferably as thick as about 0.2–1 mm, particularly about 0.3–0.7 mm, and may be substantially equal to or shorter than each annular end projection 12, 13 as long as it can slide.

Figure 4:
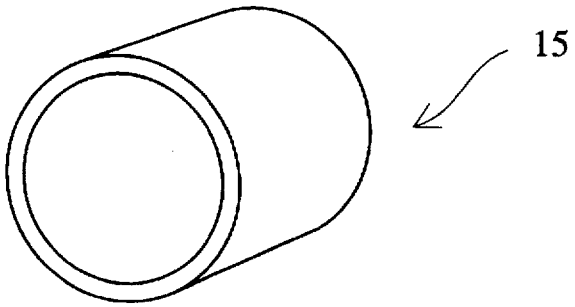
FIG. 4 (*a*) is a perspective view showing a slidable tubular member in the shape of a cylinder.
Figure 4:
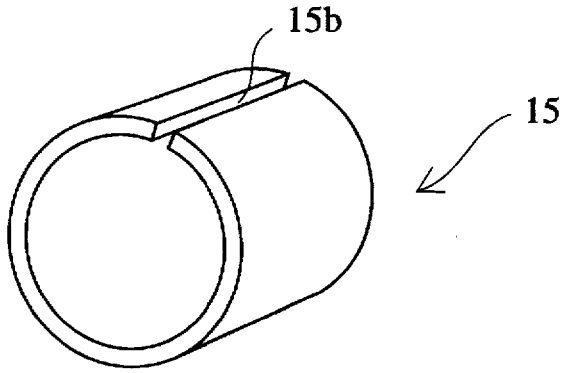
Figure 4:
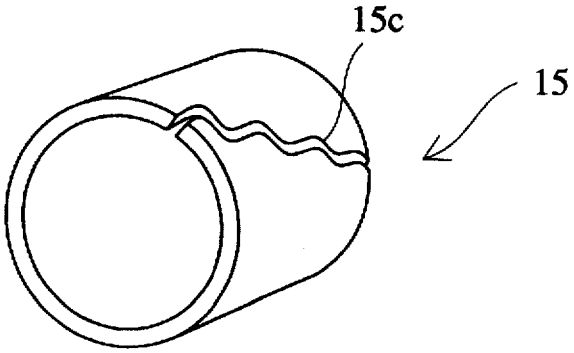
Figure 5A:
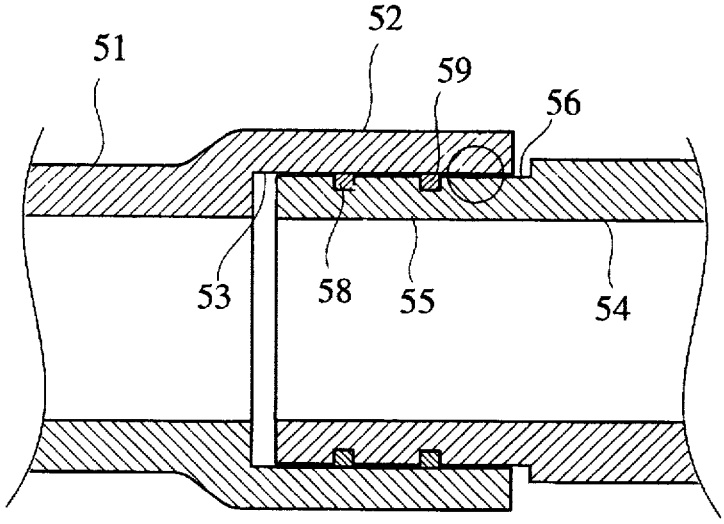
FIG. 5(a) (Prior Art)
FIG. 5(*a*) is a cross-sectional view showing an example of connection portions of conventional exhaust manifold assemblies.
Figure 5B:
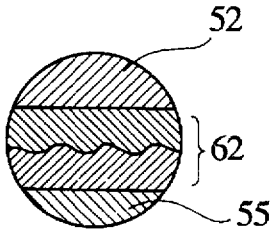
FIG. 5(b) (Prior Art)
Figure 6:
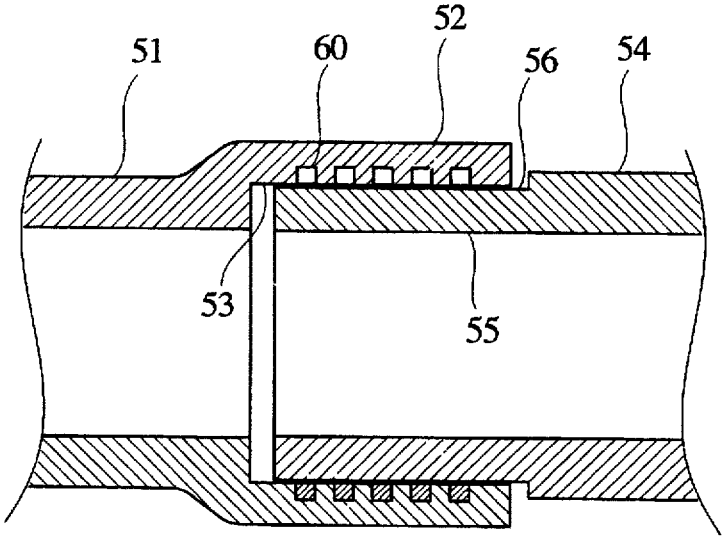
FIG. 6 (Prior Art)
FIG. 6 is a cross-sectional view showing another example of connection portions of conventional exhaust manifold assemblies.
Figure 7:
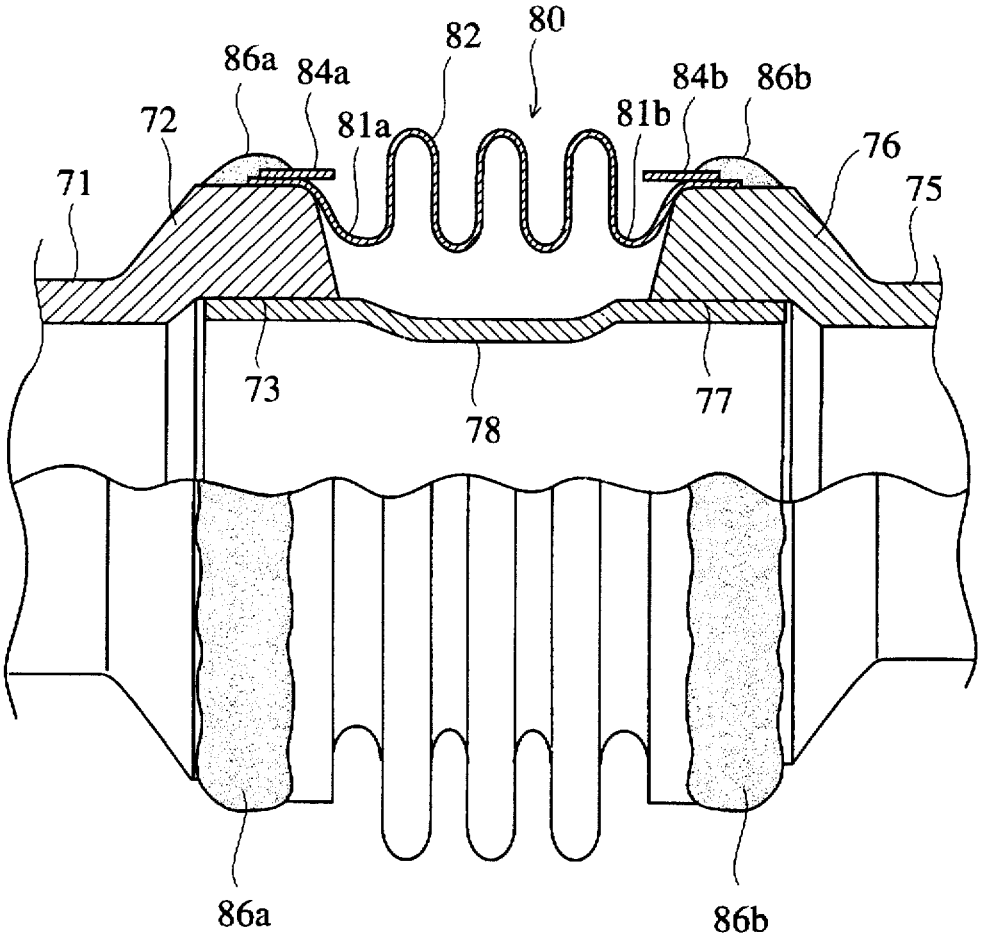
FIG. 7 (Prior Art)
FIG. 7 is a partially cross-sectional side view showing a further example of connection portions of conventional exhaust manifold assemblies.

As shown in FIGS. 4(*a*) to 4(*c*), the slidable tubular member 15 may be in various shapes. Specifically, the slidable tubular member 15 may be a cylindrical member without a slit (FIG. 4(*a*)), a cylindrical member with a linear slit extending between both ends (FIG. 4(*b*)), or a cylindrical member with a zigzag slit slantingly extending between both ends (FIG. 4(*c*)).

In the case of FIG. 4(*a*), the slidable tubular member 15 is loosely fitted between the annular end projections 12 and 13 so that it is slidable along the inner surface 12*a* of the annular end projection 12 and the outer surface 13*a* of the annular end projection 13. In the case of FIG. 4(*b*), the slidable tubular member 15 is fixed to either of the inner surface 12*a* of the annular end projection 12 and the outer surface 13*a* of the annular end projection 13. More specifically, If the outer diameter of the slidable tubular member 15 is slightly larger than the diameter of the inner surface 12*a* of the annular end projection 12, the slidable tubular member 15 can be fixed to the inner surface 12*a* of the annular end projection 12 by insertion with the slit 15*b* compressed. On the other hand, if the inner diameter of the slidable tubular member 15 is slightly smaller than the diameter of the outer surface 13*a* of the annular end projection 13, the slidable tubular member 15 can be fixed to the outer surface 13*a* of the annular end projection 13 by insertion with the slit 15*b* opened. In the case of FIG. 4(*c*), the slidable tubular member 15 can be fixed to either the inner surface 12*a* of the annular end projection 12 or the outer surface 13*a* of the annular end projection 13 essentially in the same manner as in the case of FIG. 4 (*b*).

To seal the connection portion 5 of the manifold part members 2, 3, a flexible pipe 20 is mounted around the connection portion 5. The flexible pipe 20 comprises a corrugated pipe portion 22 located at a center and tubular portions 24*a*, 24*b* integrally extending from both ends of the corrugated pipe portion 22 in the axial direction. Each tubular portion 24*a*, 24*b* may be formed by radially outwardly bending the corrugated pipe portion 22.

The end of each tubular portion 24*a*, 24*b* abuts against an annular step 26, 28 formed on the outer surface 2*a*, 3*a* of each manifold part member 2, 3. To fix the flexible pipe 20, a support ring 30 is preferably disposed around an end portion of each tubular portion 24*a*, 24*b*. When the support ring 30 is used, each tubular portion 24*a*, 24*b* and the support ring 30 are welded to each manifold part member 2, 3 along the entire circumference of the outer surface 2*a*, 3*a*, as shown by a reference numeral 32 in FIG. 2(*a*). With this welding structure, the connection portion 5 of the manifold part members 2, 3 is completely sealed by the flexible pipe 20.

Though FIG. 2 shows an example in which only the tubular portions 24*a*, 24*b* of the flexible pipe 20 abut against the annular steps 26, 28, the annular steps 26, 28 may be made higher such that the support rings 30 and the tubular portions 24*a*, 24*b* abut against the annular steps 26, 28. Also, the axial distance L between the annular end projections 12, 13 of the manifold part members 2, 3 telescopically connected to each other (distance between the root end of the annular end projection 12 and the tip end of the annular end projection 13) is preferably determined such that it is slightly larger than the maximum difference between heat expansion and shrinkage of the exhaust manifold assembly 1. With this distance L, the ends of the manifold part members 2, 3 do not interfere with each other.

[2] Second Embodiment

Figure 3:
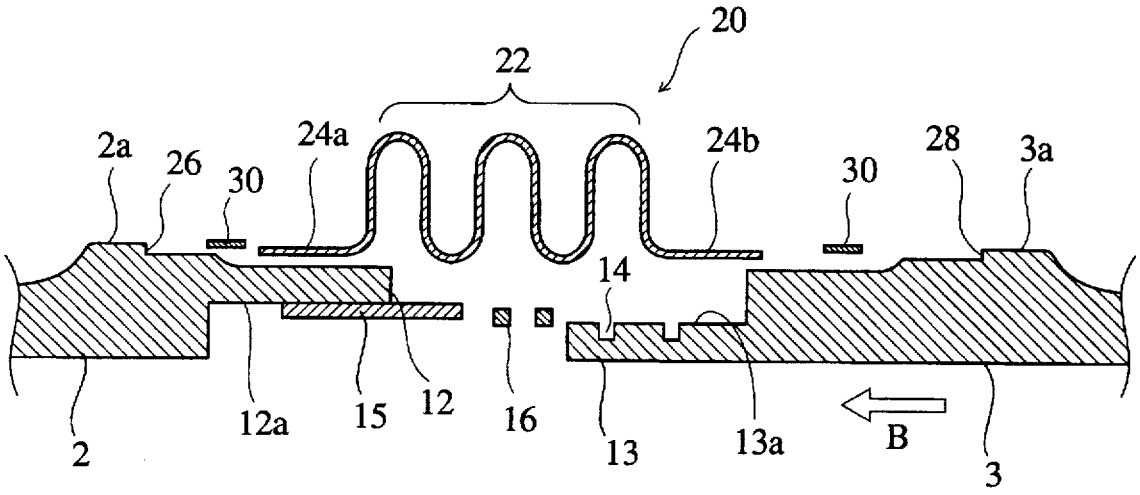
FIG. 3(*a*) is a cross-sectional view showing the connection portion of the exhaust manifold assembly according to another embodiment of the present invention.
Figure 3:
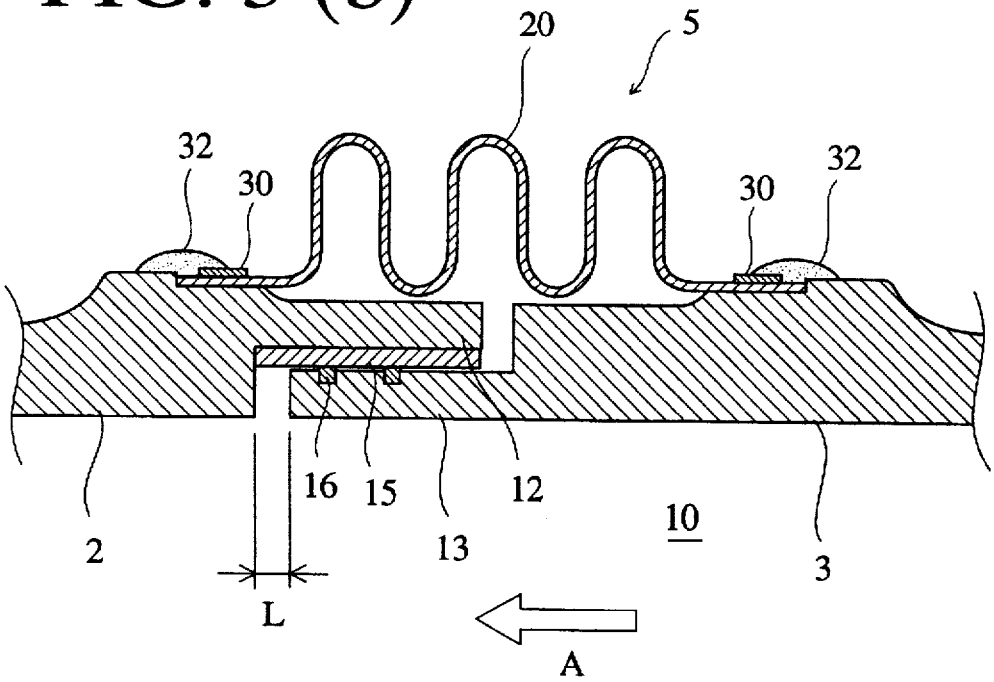

FIGS. 3(*a*) and 3(*b*) show the connection portion 5 of the exhaust manifold assembly 1 according to the second embodiment of the present invention. The structure of the exhaust manifold assembly 1 in this embodiment is the same as that of the exhaust manifold assembly 1 in the first embodiment except for annular grooves 14 and seal rings 16 inserted thereinto. Thus, explanation will be made only on the annular grooves 14 and the seal rings 16.

At least one (two in FIG. 3) annular groove 14 is formed on an outer surface 13*a* of the annular end projection 13, and a seal ring 16 in the shape of a piston ring is inserted into the annular groove 14. In this embodiment, the slidable tubular member 15 is fixed to the inner surface 12*a* of the annular end projection 12 of the manifold part member 2, and the outer surface of the seal ring 16 is in slide contact with the inner surface of the slidable tubular member 15. The shape of the slidable tubular member 15 is preferably as shown in FIG. 4(*b*).

In any of the above-described exhaust manifold assemblies 1, the slidable tubular member 15 made of a material having good heat resistance and oxidation resistance serves to prevent the adhesion and fixing of the manifold part members 2, 3 even after the manifold part members 2, 3 are oxidized and corroded by a long period of operation. Also, due to the fact that the connection portion 5 is extendable depending on thermal expansion or shrinkage due to the heating and cooling of the engine, it is possible to prevent the cracking of the manifold part members and the leakage of an exhaust gas from the connection portion.

The present invention will be explained in more detail by reference to the following examples, without intending to limit the scope of the present invention.

EXAMPLE 1

An exhaust manifold assembly having a structure shown in FIGS. 1 and 2 was produced. The distance between the adjacent inlet openings 7 was 170 mm, and the inner diameter of the path 10 was 55 mm.

Manifold part members 2, 3 were produced from high-Si, spheroidal graphite cast iron. An inner surface 12*a* of the annular end projection 12 (length: 34 mm) of the manifold part member 2 was machined to have an diameter of 66 mm (tolerance: +0.030 mm to 0 mm), and an outer surface 13*a* of the annular end projection 13 (length: 34 mm) of the manifold part member 3 was machined to have an diameter of 65 mm (tolerance: −0.030 mm to −0.060 mm). Further, the outer surfaces 2*a*, 3*a* of the manifold part members 2, 3 were machined to have annular steps 26, 28 having an outer diameter of 80 mm (tolerance: +0 mm to −0.3 mm).

A slidable tubular member 15 in a shape shown in FIG. 4(*a*) having an outer diameter of 66 mm (tolerance: −0.030 mm to −0.060 mm) and an inner diameter of 65 mm (tolerance: +0.030 mm to 0 mm) was produced from a ground stainless steel sheet (JIS SUS430), and inserted into the annular end projection 12 of the manifold part member 2. To prevent the interference of the manifold part members 2, 3 due to longitudinal heat expansion, the distance L between the root end of the annular end projection 12 and the tip end of the annular end projection 13 was set to 4 mm.

Next, a ground stainless steel sheet (JIS SUS403) having a thickness of 0.6 mm was formed into a corrugated pipe having an inner diameter of 80.4 mm (tolerance: +0 mm to −0.3 mm) and an outer diameter of 100 mm, and both end portions of the corrugated pipe were axially expanded to provide a flexible pipe 20 having a corrugated pipe portion 22 and two tubular portions 24*a*, 24*b* axially extending from both ends of the corrugated pipe portion 22. The flexible pipe 20 thus formed had a corrugated pipe portion 22 with five crests ("three crests" in FIG. 2(*b*) for simplicity). Further, a support ring 30 having an inner diameter of 81.6 mm (tolerance: +0.3 mm to +0.5 mm) and a width of 7 mm was produced from a ground stainless steel sheet (JIS SUS403) having a thickness of 0.6 mm.

As shown in FIG. 2(*b*), the manifold part members 2, 3, the flexible pipe 20 and the support ring 30 were concentrically arranged and assembled by moving the manifold part member 3 in the direction shown by the arrow B. In this case, the tubular portions 24*a*, 24*b* of the flexible pipe 20 were set at an abutment position against the steps 26, 28 of the manifold part members 2, 3, and the support ring 30 was mounted around the tubular portions 24*a*, 24*b*. In this state, the tubular portions 24*a*, 24*b* of the flexible pipe 20 and the support ring 30 were continuously welded to the outer surfaces 2*a*, 3*a* of the manifold part members 2, 3 to form leak-free welds 32.

The exhaust manifold assembly 1 having the above structure was mounted to an in-line, six-cylinder diesel engine equipped with a turbo charger for large trucks. After a 300-hour, full-load continuous durability test at 2000 rpm, a 10-minute heating-cooling cycle consisting of a full load operation at 2000 rpm for 5 minutes and idling at 500 rpm for 5 minutes was repeated 1800 times (300 hours) to examine whether or not the manifold part members 2 and 3 of the exhaust manifold assembly 1 were adhered and fixed to each other. As a result, it was found that no adhesion and fixing of the manifold part members 2 and 3 in the connection portion 5 took place even though the inner surfaces of the manifold part members 2 and 3 were oxidized and corroded.

EXAMPLE 2

An exhaust manifold assembly having a structure shown in FIGS. 1 and 3 was produced. The distance between the adjacent inlet openings 7 was 170 mm, and the inner diameter of the path 10 was 55 mm.

The same manifold part members 2, 3 and the same slidable tubular member 15 as in Example 1 were produced. The outer surface 13*a* of the annular end projection 13 of the manifold part member 3 was formed with two annular grooves 14 having a depth of 2.5 mm and a width of 2.0 mm. Also, a seal ring 16 in the shape of a piston ring (outer diameter: 66 mm, inner diameter: 61 mm, width: 1.8 mm) which should be inserted into each annular groove 14 was produced from stainless steel (JIS SUS403).

After inserting the seal rings 16 into the annular grooves 14, the manifold part members 2, 3, the flexible pipe 20 and the support ring 30 were concentrically arranged and assembled by moving the manifold part member 3 in the direction shown by the arrow B as in Example 1. After assembling, the tubular portions 24*a*, 24*b* of the flexible pipe 20 and the support ring 30 were continuously welded to the outer surfaces 2*a*, 3*a* of the manifold part members 2, 3 to form leak-free welds 32.

The exhaust manifold assembly 1 having the above structure was subjected to the same test as in Example 1. As a result, it was found that no adhesion and fixing of the manifold part members 2 and 3 in the connection portion 5 took place even though the inner surfaces of the manifold part members 2 and 3 were oxidized and corroded.

As described above in detail, by inserting the slidable tubular member into a gap between the annular end projections of the adjacent manifold part members and continuously welding the flexible pipe to the outer surfaces of the manifold part members, the exhaust manifold assembly of the present invention has a structure of complete seal. Also, since the slidable tubular member is made of a material having good heat resistance and oxidation resistance, the adhesion and fixing of the manifold part members 2, 3 can be prevented even after the manifold part members 2, 3 are oxidized and corroded by a long period of operation.

Further, since the connection portion is completely sealed by continuous welding of the flexible pipe to the outer surfaces of the manifold part members, an exhaust gas would not leak out of the connection portion even though there is a gap between the annular end projections into which the slidable tubular member is inserted. In addition, since the connection portion is extendable depending on thermal expansion and shrinkage due to the heating and cooling of engines, it is unlikely that cracking takes place in the manifold part members.

What is claimed is:

1. An exhaust manifold assembly comprising at least two manifold part members, an annular end projection of one manifold part member receiving an annular end projection of the other manifold part member to form a connection portion, further comprising:

(a) a slidable tubular member inserted into a gap between said annular end projection of one manifold part member and said annular end projection of the other manifold part member, said slidable tubular member being an annular member made of a metal material having good heat resistance and oxidation resistance; and (b) a flexible pipe comprising a corrugated pipe portion and tubular portions integrally extending from both ends of said corrugated pipe portion, said flexible pipe extending along the exhaust manifold assembly so as to cover said connection portion, said tubular portions of said flexible pipe being continuously welded to outer surfaces of said manifold part members, whereby said connection portion is completely sealed by said flexible pipe.

2. The exhaust manifold assembly according to claim 1, wherein said slidable tubular member has a slit extending between both ends thereof, said slidable tubular member being fixed to the inner surface of the annular end projection of one manifold part member or to the outer surface of the annular end projection of the other manifold part member due to its resiliency.

3. The exhaust manifold assembly according to claim 1, wherein a support ring is disposed around an outer surface of each tubular portion of said flexible pipe, said flexible pipe and said support ring being welded to the outer surfaces of said manifold part members.

4. The exhaust manifold assembly according to claim 1, wherein the outer surface of the annular end projection of the other manifold part member is provided with a plurality of annular grooves, and a seal ring is mounted to each annular groove, the sliding contact of said slidable tubular member with said support rings reducing the leakage of an exhaust gas from said connection portion.

5. The exhaust manifold assembly according to claim 2, wherein the outer surface of the annular end projection of the other manifold part member is provided with a plurality of annular grooves, and a seal ring is mounted to each annular groove, the sliding contact of said slidable tubular member with said support rings reducing the leakage of an exhaust gas from said connection portion.

6. The exhaust manifold assembly according to claim 3, wherein the outer surface of the annular end projection of the other manifold part member is provided with a plurality of annular grooves, and a seal ring is mounted to each annular groove, the sliding contact of said slidable tubular member with said support rings reducing the leakage of an exhaust gas from said connection portion.

7. The exhaust manifold assembly according to claim 1, wherein each manifold part member is provided with an annular step on its outer surface, each tubular portion of said flexible pipe in abutment against said annular step being welded to the outer surface of each manifold part member.

8. The exhaust manifold assembly according to claim 2, wherein each manifold part member is provided with an annular step on its outer surface, each tubular portion of said flexible pipe in abutment against said annular step being welded to the outer surface of each manifold part member.

9. The exhaust manifold assembly according to claim 3, wherein each manifold part member is provided with an annular step on its outer surface, each tubular portion of said flexible pipe in abutment against said annular step being welded to the outer surface of each manifold part member.

* * * * *